United States Patent [19]

Misiura et al.

[11] Patent Number: 4,975,997

[45] Date of Patent: Dec. 11, 1990

[54] BEDCLOTHES SUPPORTING DEVICE

[76] Inventors: Theresa R. Misiura; Anthony R. Misiura, Sr., both of 265 N. Main St., Moscow, Pa. 18444

[21] Appl. No.: 514,889

[22] Filed: Apr. 26, 1990

[51] Int. Cl.[5] ..... A47C 21/02

[52] U.S. Cl. ..... 5/505

[58] Field of Search ..... 5/504, 505, 506, 503; 248/287

[56] References Cited

U.S. PATENT DOCUMENTS

| | | | |
|---|---|---|---|
| 1,072,490 | 9/1913 | Oilar | 5/505 |
| 1,577,825 | 3/1926 | Denness . | |
| 2,607,933 | 8/1952 | Fulton | 5/505 |
| 2,668,963 | 2/1954 | Drake | 5/505 |
| 2,960,151 | 11/1960 | Fairgrieve . | |
| 3,639,929 | 2/1972 | Icmise | 5/504 |
| 4,214,327 | 7/1980 | Smith | 5/504 |
| 4,570,275 | 2/1986 | Merriman | 5/505 |

*Primary Examiner*—Alexander Grosz

*Attorney, Agent, or Firm*—Terry M. Gernstein

[57] ABSTRACT

A bedclothes supporting device is mounted between the mattress and box spring or like and extends on each side of the bed and supports the bedclothes so that a person in the bed will be comfortable. The device is adjustable so that the maximum comfort can be achieved and the device can be collapsed for storage or for permitting the bedclothes to be easily changed. The device includes clamps so that the device will be secure and will securely hold the bedclothes in the desired position. Also the device may be moved to any location on the bed where it will provide the maximum comfort level, and will securely hold the bedclothes in the desired position.

3 Claims, 3 Drawing Sheets

BEDCLOTHES SUPPORTING DEVICE

TECHNICAL FIELD OF THE INVENTION

The present invention relates to the general art of bedding, and to the particular field of bedclothing.

BACKGROUND OF THE INVENTION

Many people, especially bedridden patients, are required to spend a great deal of time in bed. If someone is bedridden for a great length of time, particularly for foot or leg problems, the bedclothing can create a comfort problem. However, there are many People who find it uncomfortable to have bedclothing resting on their feet or legs.

Therefore, the bedding art includes several examples of devices that are intended to relieve the pressure of bedclothing from a person's feet and legs. However, most of these devices are not very practical and interfere with the comfort of the person in the bed.

Therefore, they cannot achieve a wide range of adjustability and thus, such devices have not achieved a full measure of commercial success.

Therefore, there is a need for a bedclothes suPPorting device which is fully adjustable and which can be conveniently adjusted to allow for bedclothing changes.

OBJECTS OF THE INVENTION

It is the main object of the present invention to provide a bedclothing supporting device which is fully adjustable.

It is another object of the present invention to provide a bedclothes supporting device which is fully adjustable and which can be placed in the bed furniture in such a manner as not to interfere with the person in the bed.

SUMMARY OF THE INVENTION

These, and other, objects are achieved by a bedclothing supporting device that includes a U-shaped that fits around the outside of a mattress-supporting element. The device rests on a box spring and engages the bedclothes on each side of the mattress. The device includes telescoping sections so its width and height dimensions can be adjusted. The device further includes elements for securely holding the bedclothes in place.

In this manner, the device can be easily moved out of the way to change the bedclothes and can be adjusted to provide the maximum amount of comfort.

DETAILED DESCRIPTION OF THE PREFERRED EMBODIMENT OF THE INVENTION

Shown in FIGS. 1–6 is a first form of an adjustable bedclothes-supporting device 10 which is located between a mattress and a box spring or like support for supporting the bedclothing in a position so that such bedclothing does not contact a bed occupants feet or body in a manner that applies uncomfortable pressure to such feet or body.

Figure 2:
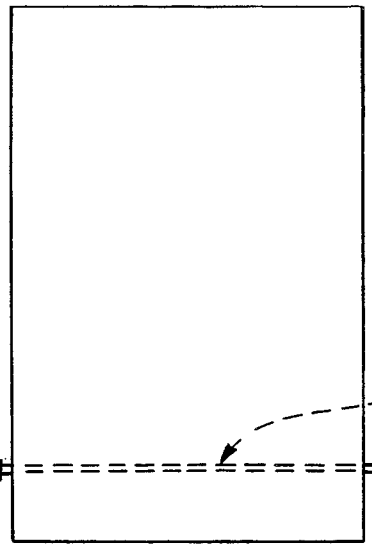
FIG. 2 is a top plan view of the bedclothes-supporting device in position.
Figure 3:
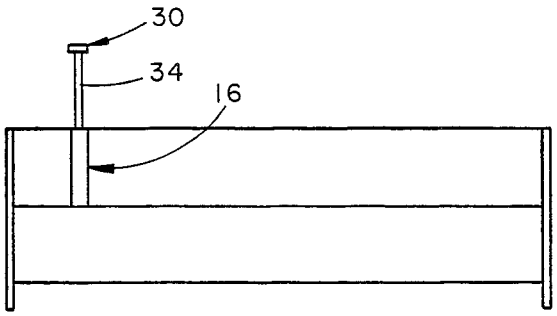
FIG. 3 is a side elevational view of the bedclothes-supporting device in position.
Figure 4:
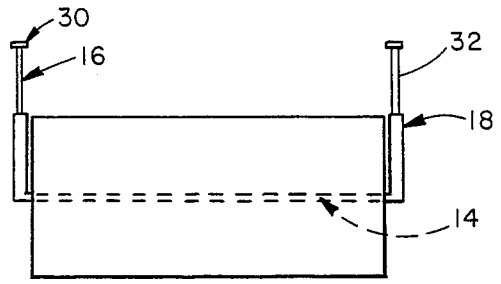
FIG. 4 is an end elevational view of the bedclothes-supporting device in position.
Figure 5:
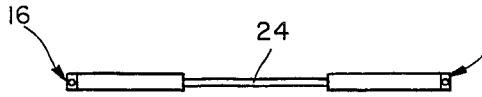
FIG. 5 is a top plan view of the bedclothes-supporting device having anti-roll elements thereon.
Figure 6:
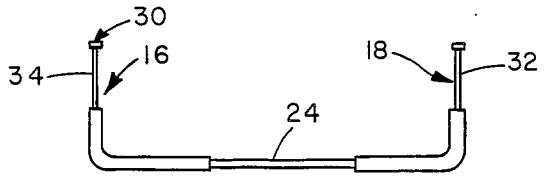
FIG. 6 is a partial side elevational view of the device having a bedclothing clamp thereon.

The device 10 includes a U-shaped support 12 which has a base section 14 that, as indicated in FIGS. 2–4 as resting on the box spring or like support, elevates the bedclothes-supporting element above the level of the mattress.

The base section 14 includes first and second L-shaped end sections 16 and 18 each of which has a first horizontally-oriented leg such as leg 20 and a second vertically-oriented leg, such as leg 22 on first end section 16. The end section legs are hollow rectangular cylinders and are connected together by a connecting element 24 that is telescopingly received in each of the end section horizontally-oriented legs so that the end sections can be moved toward and away from each other as indicated in FIG. 1 by the double-headed arrow 26 whereby the device 10 can be adjusted for varying widths of bedclothes-supporting elements and can be located to provide the maximum comfort to a bedridden patient.

Figure 1:
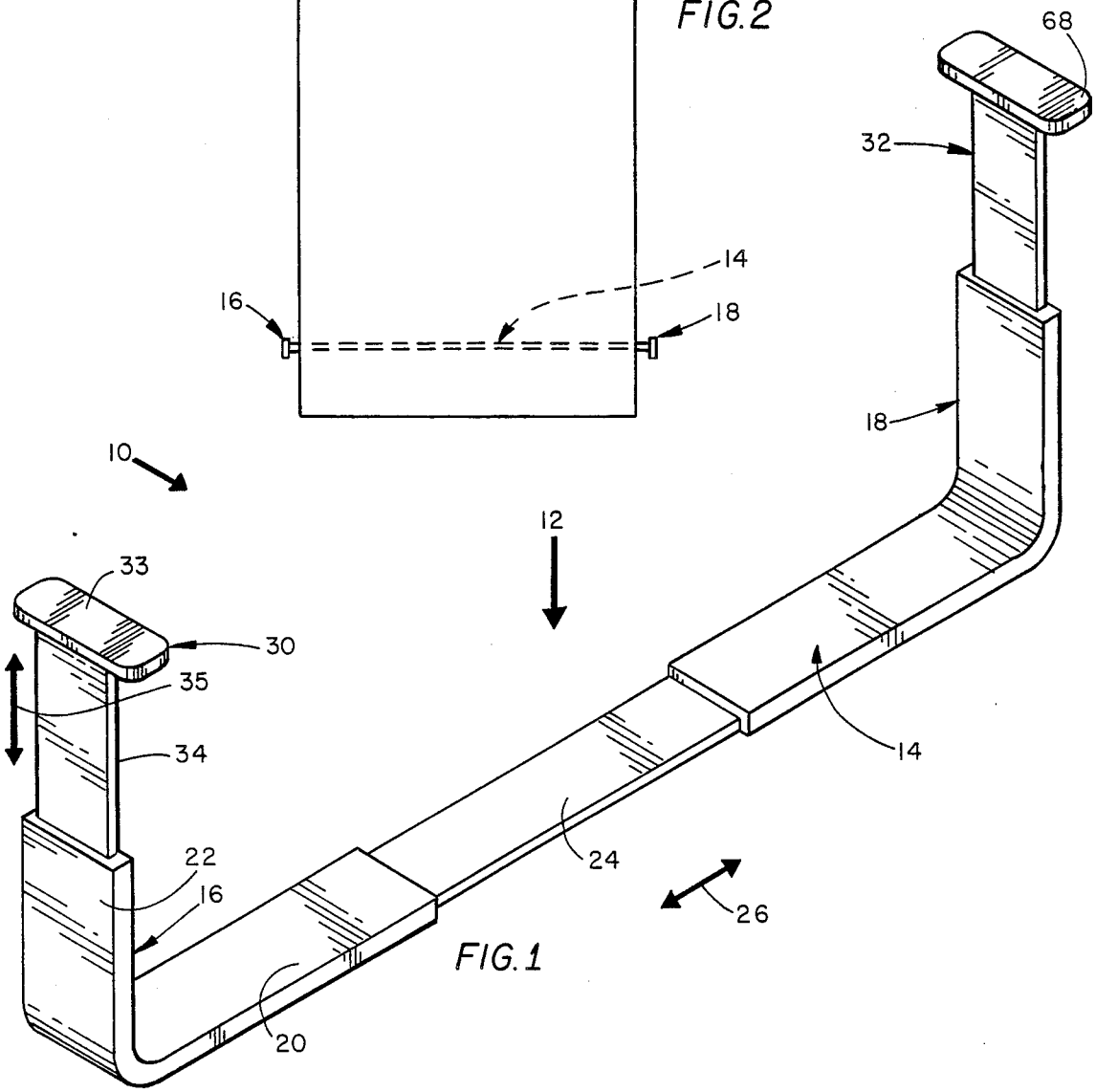
FIG. 1 is a perspective view of the bedclothes supporting-device of the present invention.

The T-shaped bedclothes-engaging elements 30 and 32 are included in the device 10, with one of such elements being telescopingly connected to each of the end section vertically-oriented legs as shown in FIG. 1. Each of the elements 30 and 32 includes a top portion such as top portion 33 of element 30 and a body portion such as body portion 34 of element 30 that is frictionally received in the end sections and can be moved vertically in the direction of double-headed arrow 35 to adjust the height with which the bedclothes are supported above the top of the mattress on which the patient rests. The friction fit, between the elements 30 and 32 and the end sections 16 and 18, is adjusted so that the normal weight of the bedclothes will not force the elements downwardly, and extra force must be exerted to cause such collapsing. In this manner, the elements can be easily Placed in the location to provide the desired amount of elevation to the bedclothes, and will remain in such position until manually forced back into the end elements.

Thus, the device 10 can be adjusted both widthwise and heightwise thereof. In this manner, the device can be set for maximum comfort, yet can easily be stored out of the way when the bedclothes are being changed.

The top portions of the T-shaped elements can include knurling, such as knurling 68 on element 32, to further enhance the bedclothes-holding feature of the device.

Figure 7:
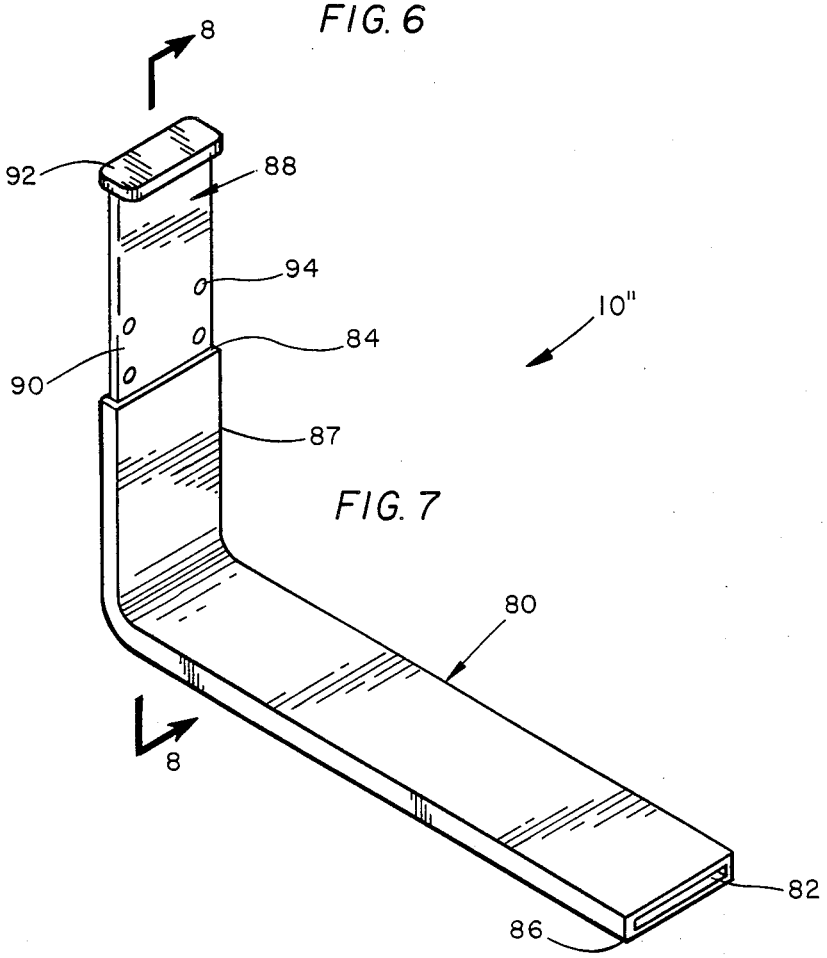
FIG. 7 is a perspective view of the device with details of the vertical slide and bedclothes holding embodiment of the invention.
Figure 8:
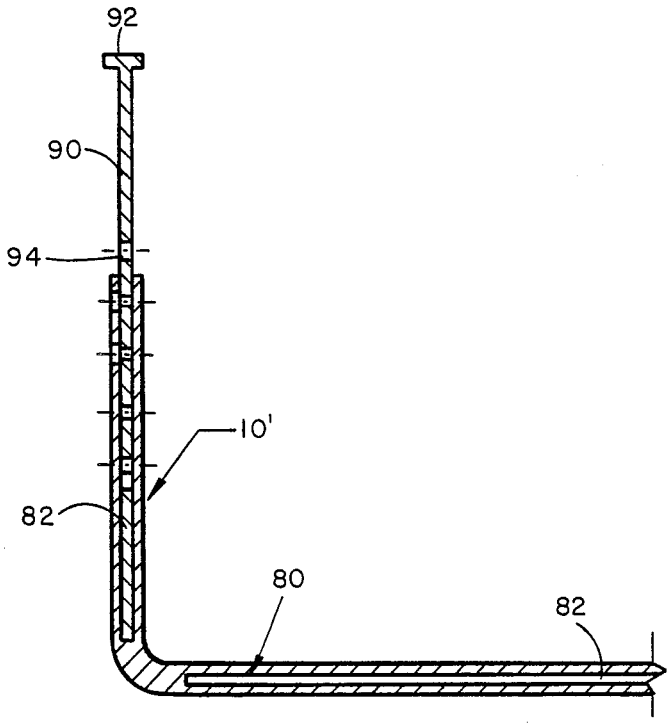
FIG. 8 is an elevational view taken along line 8—8 of FIG. 7.

Shown in FIGS. 7 and 8 is an alternative adjustable bedclothes-supporting device 10' which includes an L-shaped base 80 having blind-ended slots 82 defined in ends 84 and 86 thereof. The base is adapted to rest beneath the mattress portion of the bed, with one base on each side of the bed as above described so that short leg 87 of the base is located outside of the perimeter of the mattress. An extension element 88 is slidably received in slot 84 of leg 87 and is T-shaped to have a base-engaging body 90 and a bedclothes-engaging head 92.

A plurality of fastener-receiving holes, such as hole 94, are defined through the body 90 and are spaced apart along the length of that body. A fastener (not shown), such as a bolt, or the like, is received through the holes 94 to engage the base short leg 87 and support the head 92 at a desired height to support the bedclothes above the top surface of the bed. One unit is located on each side of the bed to support the bedclothes as above described. Additionally, these devices can be used singly, or in any combination along the length of the bed, to provide a maximum amount of relief that may be required for the person in the bed.

Figure 9:
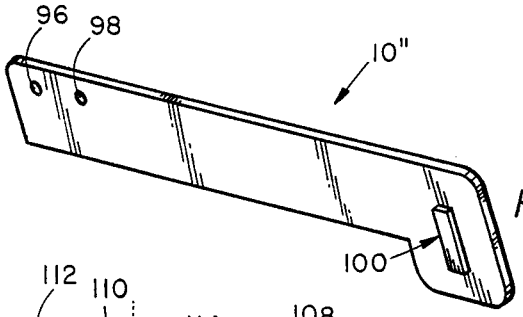
FIG. 9 is a perspective view of another alternative embodiment of the invention.

FIG. 9 is a perspective view of another alternative embodiment of the invention.

A bedclothes-supporting unit 10″ can be used in conjunction with a base 80 (FIG. 8) to support bed clothes. The device 10″ is L-shaped and has two fastener receiving holes 96 and 98 defined therethrough adjacent to one end thereof and a bedclothes-engaging head 100 on the other end thereof. The device 10″ is attached to that short leg 87 (FIG. 8) via the fastener receiving holes and the height of the device 10″ to support the bedclothing.

Figure 10:
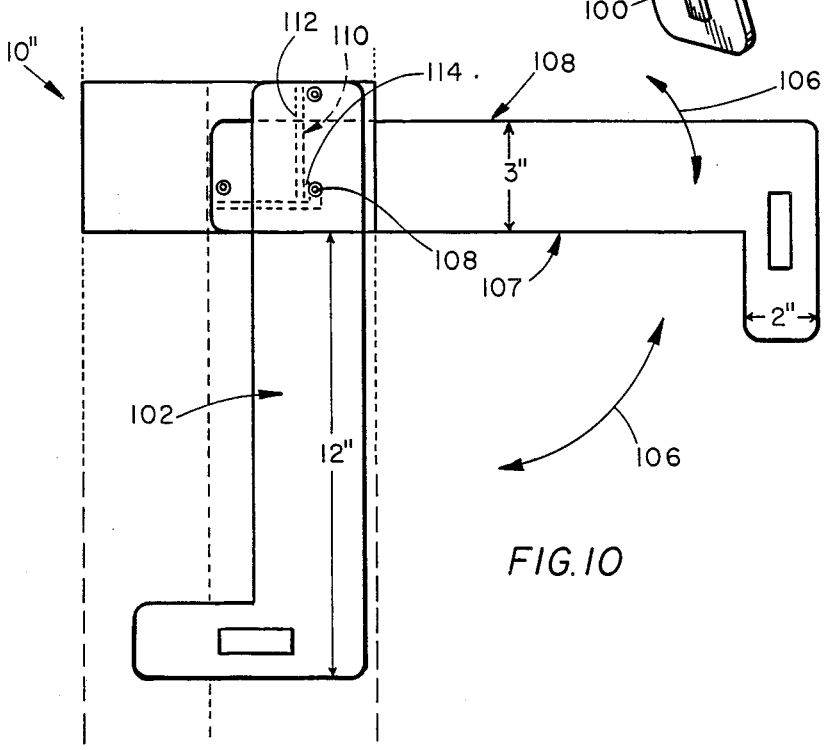
FIG. 10 is an end elevational view of the alternative embodiment of the invention as it would be applied to the horizontal leg of the invention with a bedclothes-supporting device incorporated.

Yet a further view of device 10″ is shown in FIG. 10 and includes a bedclothes engaging element 107 which rotates up or down as indicated by double-headed arrow 106.

The device 10″ extends perpendicularly to the mattress and to the base 80 (FIG. 8) in the upright position, shown by the arrow 104.

The device 10″ extends longitudinally to the mattress and the base 80 (FIG. 8) in the down position, shown by arrow 102, which facilitates the dressing of the bed. The element 107 is attached to the short leg 87 by fasteners, such as 108, that are sized and adapted to extend through both the short leg 87 (FIG. 8) and the element 107 and are movably mounted in element 107 in a slot system 110. The slot sYstem 110 includes long slots such as slot 112 and short slots such as slot 114 which intersect the long slots so that the fasteners, the base and the element 107 can all be moved with respect to each other.

It understood that while certain forms of the present invention have been illustrated and described herein, it is not to be limited to the specific forms or arrangements of parts described and shown.

We claim:

1. A bedclothes supporting device comprising:

a U-shaped support which includes a base section which rests on a box spring or like supporting element, and first and second L-shaped end sections which are located on one side of and outside of the perimeter of a mattress, each L-shaped section having a horizontally-oriented leg and a vertically-oriented leg, with each leg being hollow, said base section including a connecting element which telescopingly connects to said horizontally-oriented leg of each of said first and second L-shaped end sections and movably coupling said end sections together, a T-shaped bedclothes-engaging element telescopingly connected to said vertically-oriented leg of each end section and extending upwardly therefrom, said T-shaped elements each including a body connected to said end section and a top portion extending transversely of said body, said T-shaped elements being frictionally engaged with said end section vertically oriented sections with sufficient force to support bed clothes, such as sheets, covers and bedspreads above a top surface of a mattress upon which a person rests.

2. The bedclothes supporting device defined in claim 1, further including a bedclothes clamp on each end section

3. The bedclothes supporting device defined in claim 2, further including knurling on each T-shaped element.

* * * * *